US005929403A

United States Patent [19]

Amonett et al.

[11] Patent Number: 5,929,403

[45] Date of Patent: Jul. 27, 1999

[54] APPLIANCE TIMER HAVING A MASKABLE DOUBLE THROW SUBINTERVAL MECHANISM

[75] Inventors: Daniel K. Amonett, Marion County; Lloyd C. Worley, Hendricks County, both of Ind.

[73] Assignee: Emerson Electric Co., St. Louis, Mo.

[21] Appl. No.: 08/978,081

[22] Filed: Nov. 25, 1997

[51] Int. Cl.[6] ..... H01H 7/12

[52] U.S. Cl. ..... 200/38 B

[58] Field of Search ..... 200/38 B, 38 D

[56] References Cited

U.S. PATENT DOCUMENTS 4,577,179 3/1986 Chambers et al. ..... 200/38 R X 4,677,260 6/1987 Nagasaki et al. ..... 200/38 B X 4,892,983 1/1990 Bogda et al. ..... 200/38 R 5,652,418 7/1997 Amonett ..... 200/38 B

*Primary Examiner*—Renee S. Luebke

*Attorney, Agent, or Firm*—Mark D. Becker

[57] ABSTRACT

A timer for controlling an appliance includes a top subinterval circuit which is used to control an appliance function. The top subinterval circuit has electrical circuit blades which are movable to open and to close the top subinterval circuit. The timer also includes a subinterval lever which contacts a subinterval cam. The subinterval lever is movable in response to the subinterval cam to impart motion to the circuit blades. This movement acts to open and to close the top subinterval circuit. Moreover, the timer includes a masking lever that engages the circuit blades to prevent the closing of the top subinterval circuit. Thereby the motion of the subinterval lever is masked.

20 Claims, 10 Drawing Sheets

APPLIANCE TIMER HAVING A MASKABLE DOUBLE THROW SUBINTERVAL MECHANISM

BACKGROUND OF THE INVENTION

The present invention relates generally to timing devices, and more specifically to an appliance timer having a sub-interval circuit for providing switching functions during the normal dwell time of the timer.

Appliance timers are commonly used in many household appliances, such as dishwashers, clothes washers, and clothes dryers. The appliance timer controls operation of the appliance by actuating and deactuating switch assemblies which start and stop various work functions within the appliance such as a rinse function in the case of a clothes washer. The switch assemblies within the appliance timer are actuated and deactuated as a result of interaction between a number of cam surfaces defined in a camstack of the appliance timer and a number of cam followers which are respectively associated with the switch assemblies.

Each of the switch assemblies typically includes an upper circuit blade and a lower circuit blade with an intermediate circuit blade positioned therebetween. A first end of each of the upper, lower, and intermediate circuit blades includes a terminal which is electrically coupled to components associated with the appliance.

A second end of each of the upper, lower, and intermediate circuit blades cooperate with the camstack of the appliance timer. Typically, the upper circuit blade and the lower circuit blade are generally passive, whereas the intermediate circuit blade is generally active. In particular, the second end of the lower circuit blade has a blade support molded thereto. A bottom edge of the blade support contacts a portion of the camstack which does not have a varying cam surface defined therein. Therefore, as the camstack rotates, the lower circuit blade is not moved upwardly or downwardly. Moreover, a top edge of the blade support supports the second end of the upper circuit blade. Hence, rotation of the camstack does not cause the upper circuit blade to be moved upwardly or downwardly.

However, the intermediate circuit blade includes a cam follower which cooperates with a cam surface defined in the camstack. When the cam follower encounters a drop defined in the cam surface, the intermediate circuit blade is placed into electrical contact with the lower circuit blade. More specifically, the intermediate circuit blade includes an electrical contact that is urged into contact with a similar electrical contact included in the lower circuit blade when the intermediate circuit blade is dropped onto the lower circuit blade. To subsequently break the electrical contact between the intermediate circuit blade and the lower circuit blade, cam lift is defined in the cam surface which lifts the cam follower of the intermediate circuit blade back to its original position.

In order to place the intermediate circuit blade in electrical contact with the upper circuit blade, a cam lift (as opposed to a drop) is defined in the cam surface of the camstack. As the camstack is rotated, the cam follower of the intermediate circuit blade is advanced up the cam lift of the cam surface thereby placing the intermediate circuit blade into electrical contact with the upper circuit blade. More specifically, the electrical contact of the intermediate circuit blade is urged into contact with a similar electrical contact included in the upper circuit blade. To subsequently break the electrical contact between the intermediate circuit blade and the upper circuit blade, a drop is defined in the cam surface which drops the cam follower of the intermediate circuit blade back to its original position.

A subinterval circuit of a washer or dishwasher timer is used to provide switching for functions such as spray rinse in a washing machine and water fill valves in a dishwasher. Historically, the subinterval circuit has been limited to a single bottom circuit. The circuit is typically put on a bottom blade where it can easily be actuated by a subinterval lever that follows a subinterval cam profile. This profile causes the subinterval lever to open and close a bottom set of contacts by lifting and dropping the intermediate circuit blade of this circuit. When the intermediate blade is lifted by the sub-interval lever, the circuit is open, when the intermediate blade is dropped by the sub-interval lever the circuit is closed. The subinterval lever is actuated by a cam profile which is molded as a part of the primary drive cam of the timer. Since the subinterval lever is actuated by the primary drive cam, this make/break action occurs every interval. If it is desired that the circuit not be made during some intervals, it can be masked off by a neutral radius on the main timer camstack. This way, even though the subinterval cam profile allows the subinterval lever to drop, the intermediate blade is still held in the neutral position by the neutral cam profile of the main timer camstack. When it is desired that the circuit be made, the main timer camstack profile is made to have a bottom radius, allowing the intermediate blade to drop and make the bottom circuit when the subinterval lever is actuated by the subinterval cam.

With washing machines becoming more complex and offering more features, it is now desirable to provide a double throw subinterval circuit, where the subinterval cam has three profiles, bottom, neutral, and top. This allows the subinterval lever to actuate the intermediate blade to make and break both a bottom and a top circuit. The bottom circuit is still masked out by the cam profile on the main timer camstack as described above but the top circuit will make every interval per the top radius of the subinterval cam profile. Since it is desirable to have this top circuit not operate every interval, historically it has been turned off electrically through the use of another circuit of the timer. This uses an additional circuit in the timer that could be used to control other machine operations thereby reducing the flexibility of the appliance timer and adding complexity to the timer wiring.

What is needed therefore is an appliance timer that includes a double throw subinterval which allows for the subinterval lever to actuate the intermediate blade to make and break both bottom and top circuits and a mechanical means of masking off the top circuit of a double throw subinterval circuit. This would eliminate the need for a separate electrical circuit to mask off the top circuit of the double throw subinterval switch.

SUMMARY OF THE INVENTION

In accordance with a first embodiment of the present invention, there is provided a timer for controlling an appliance which comprises a top subinterval circuit that controls an appliance function. The top subinterval circuit has electrical circuit blades which are movable to open and to close the top subinterval circuit. The timer also includes a subinterval lever which contacts a subinterval cam, the subinterval lever is movable in response to the subinterval cam to impart motion to the circuit blades to open and to close the top subinterval circuit. A masking lever engages the circuit blades to prevent the closing of the top subinterval circuit to mask the motion of the subinterval lever.

In accordance with a second embodiment of the present invention, there is provided a timer for controlling an appliance which includes a camstack that has a plurality of program blades corresponding to predetermined appliance functions. The timer further includes a camstack drive which is coupled to the camstack to rotate the camstack and a top subinterval circuit, the making and breaking of which controls an appliance function. The timer also includes a subinterval lever which has a first end and a second end, the first end contacts the camstack drive to impart predetermined motion to the subinterval lever. The second end contacts the top subinterval circuit. A masking lever engages one of the program blades and contacts the top subinterval circuit to prevent the making and breaking of the top subinterval circuit.

In accordance with a third embodiment of the present invention, there is provided a timer for controlling an appliance which includes a camstack having a plurality of program blades corresponding to predetermined appliance functions and a camstack drive which is coupled to the camstack to rotate the camstack. Also included is a subinterval circuit having a bottom circuit blade, a top circuit blade, and an intermediate circuit blade disposed between said bottom and said top circuit blades. The intermediate circuit blade is movable between a raised position where the intermediate circuit blade makes a top subinterval circuit and a lowered position where the intermediate blade makes a bottom subinterval circuit. A subinterval lever which has a first end that contacts the camstack drive and a second end which is positioned in working relation with the intermediate blade is pivotally mounted and movable in response to the camstack drive to move the intermediate circuit blade into contact with the top circuit blade or with the bottom circuit blade. A masking lever engages a camstack program track and is movable between a raised position and a lowered position according to the program blade. When the masking lever is in the raised position the masking lever raises the upper blade beyond the travel of the intermediate blade thereby preventing the making of the top subinterval circuit. When the masking lever is in the lowered position, the masking lever lowers the upper blade to allow the making of the top subinterval circuit.

It is therefore an object of the present invention to provide a new and useful timer for controlling an appliance.

It is a also an object of the present invention to provide an appliance timer that includes a double throw subinterval circuit mechanism that allows for the masking of the subinterval lever without utilizing a separate circuit of the timer to electrically turn off the circuit.

It is further an object of the present invention to provide an appliance timer that utilizes a double throw subinterval which does not add complexity to the timer wiring.

The above and other objects, features, and advantages of the present invention will become apparent from the following description and the attached drawings.

DETAILED DESCRIPTION OF THE INVENTION

Figure 1:
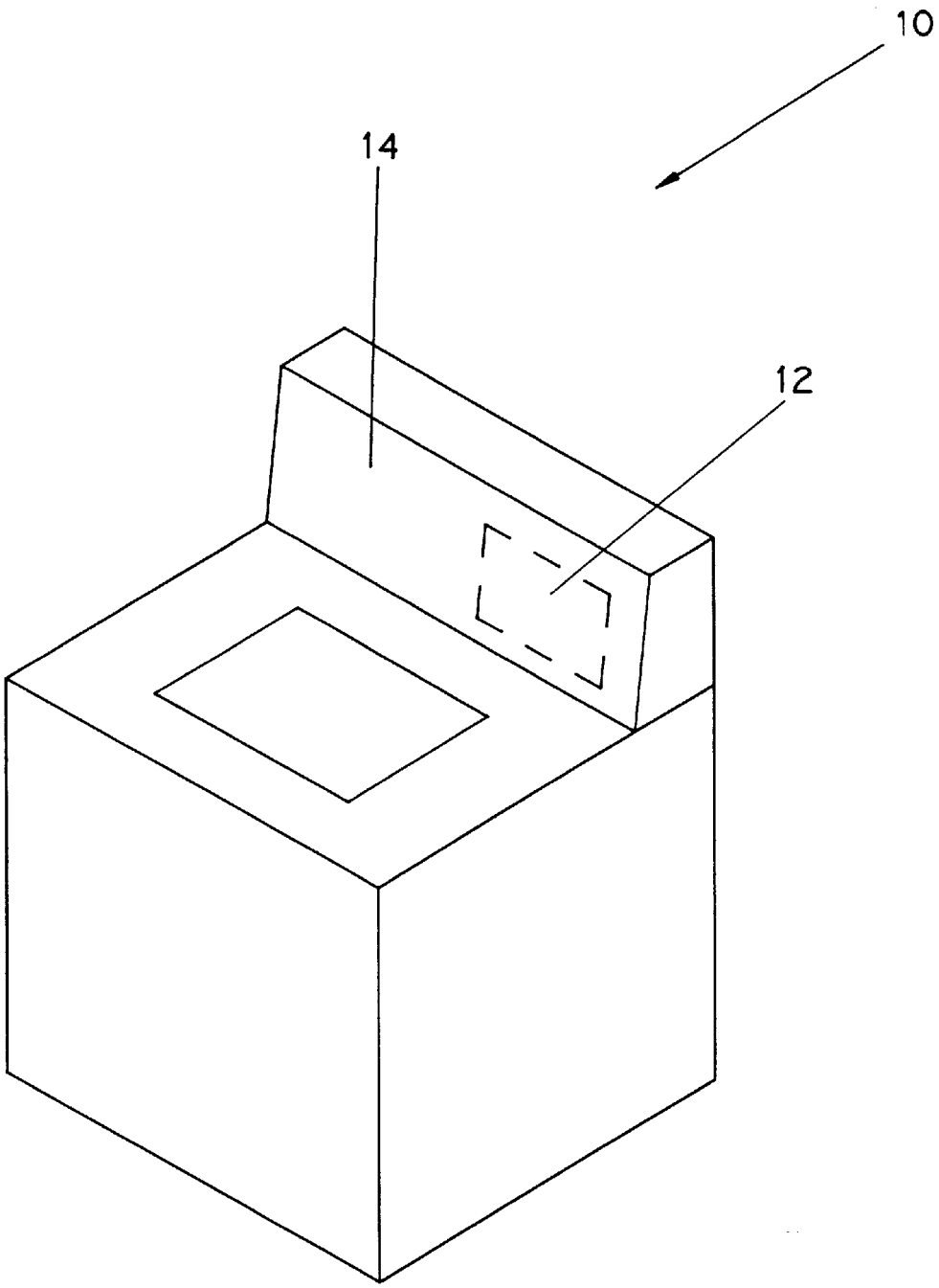
FIG. 1 is a perspective view of an appliance which includes an appliance timer which incorporates the features of the present invention therein.

While the invention is susceptible to various modifications and alternative forms, a specific embodiment thereof has been shown by way of example in the drawings and will herein be described in detail. It should be understood, however, that there is no intent to limit the invention to the particular form disclosed, but on the contrary, the intention is to cover all modifications, equivalents, and alternatives falling within the spirit and scope of the invention as defined by the appended claims.

Referring now to FIG. 1, there is shown an appliance 10 such as a clothes washing machine. The appliance 10 includes an appliance timer 12. The appliance timer 12 is secured to a console 14 of the appliance 10.

The appliance timer 12 controls various work functions associated with the appliance 10. Examples of such work functions include agitation, washing, spinning, rinsing, drying, dispensing detergent or fabric softener, hot water filling, cold water filling, and water draining.

Figure 2:
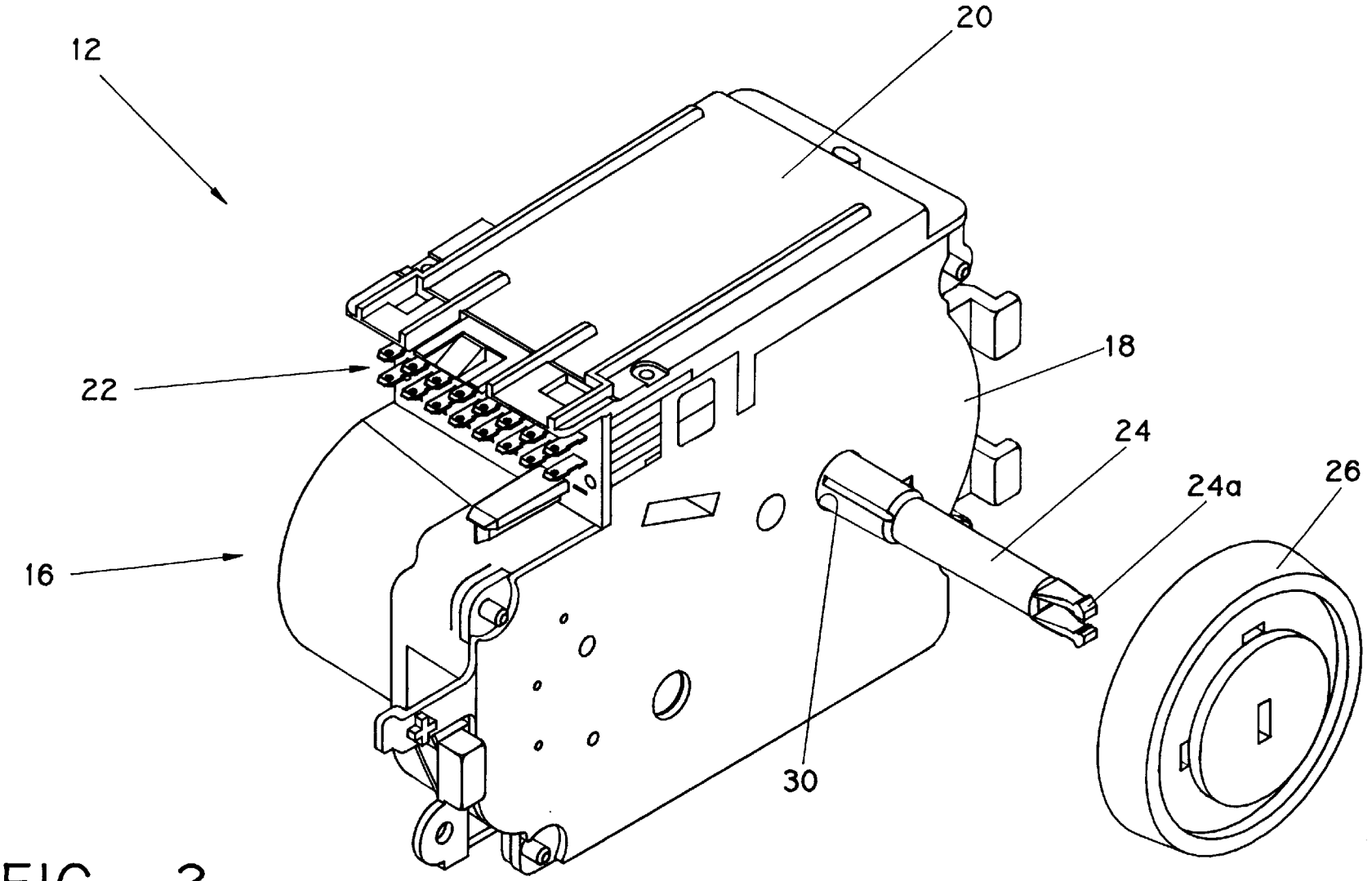
FIG. 2 is a perspective view of the appliance timer of the appliance of FIG. 1.
Figure 3:
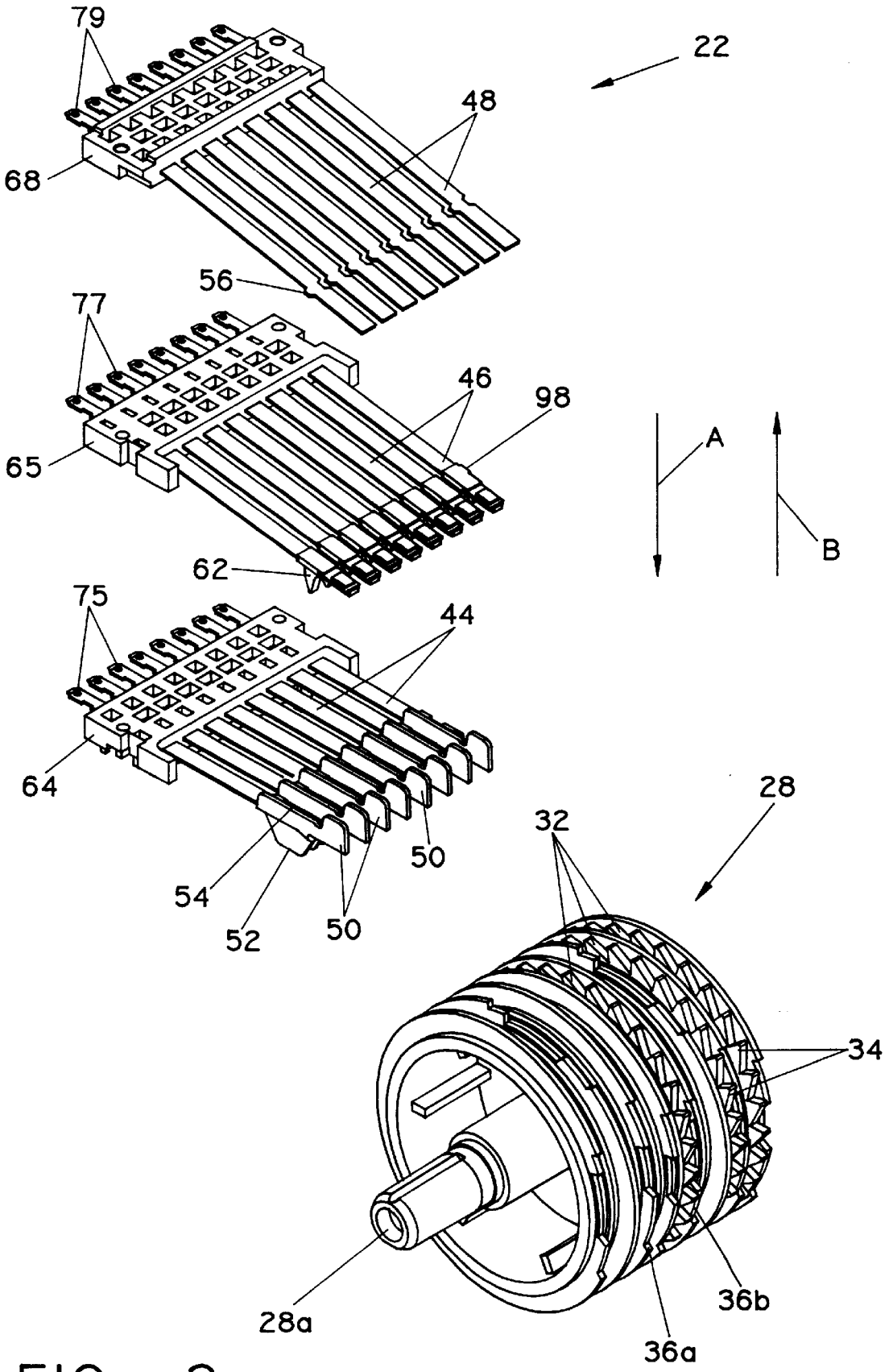
FIG. 3 is an exploded perspective view showing the relationship between the switch assembly and the camstack of the appliance timer of FIG. 2.
Figure 4:
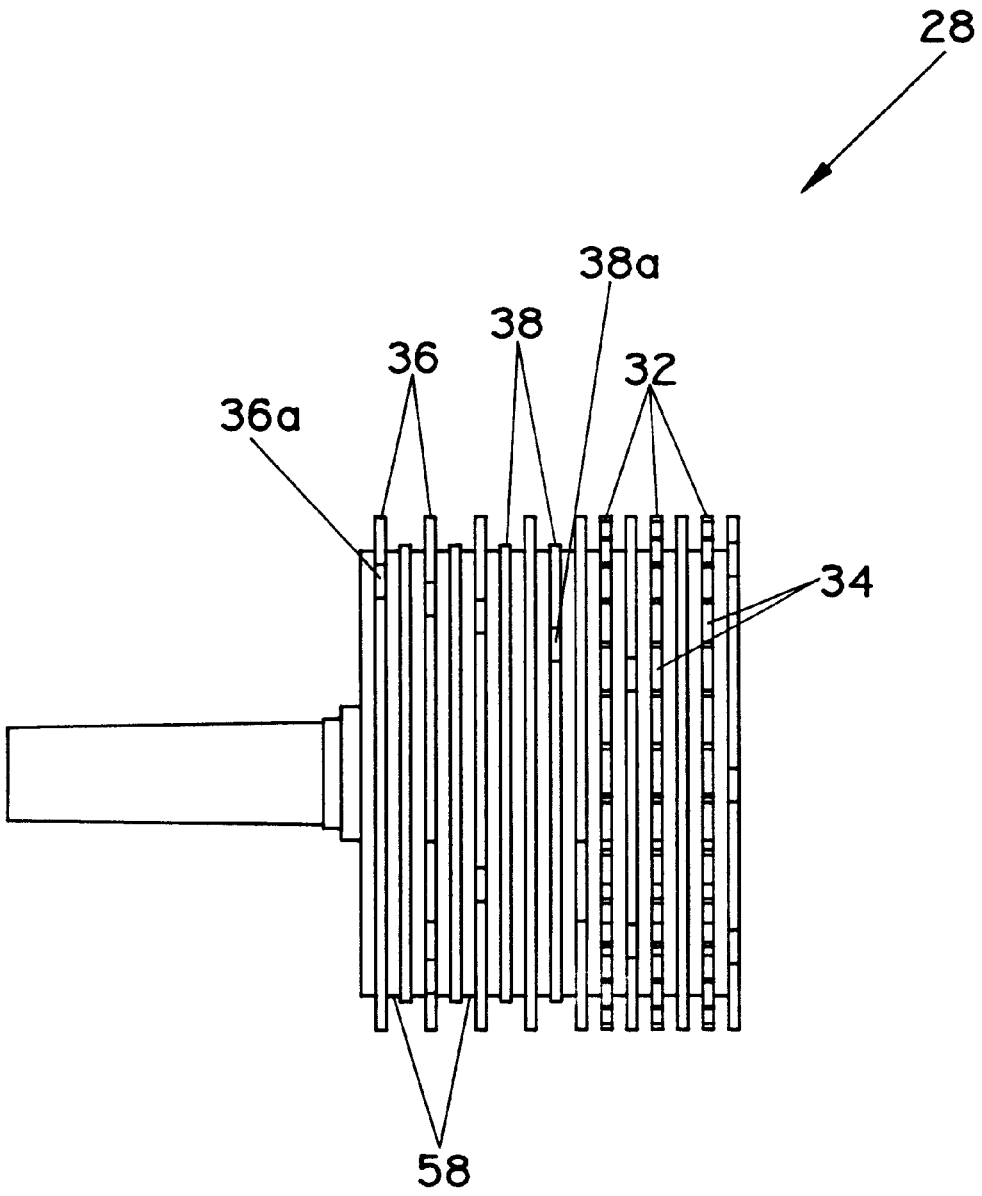
FIG. 4 is a side elevation view of the camstack of FIG. 3.

Referring now to FIGS. 2–4, there is shown the appliance timer 12 in more detail. The appliance timer 12 includes a housing 16, a side plate 18, a top plate 20, a switch assembly 22, a control shaft 24, a knob 26, and a camstack 28. An operator of the appliance 10 may set the appliance timer 12 to a desired setting by manipulating the knob 26. In particular, the operator of the appliance 10 may push the knob 26 inwardly and thereafter rotate the knob 26 in order to set the appliance timer 12 to a desired setting.

The camstack 28 is secured to the control shaft 24. In particular, the control shaft 24 is received through a central bore 28*a* defined in the camstack 28 in order to be secured thereto. One manner of securing the camstack 28 to the control shaft 24 is with a clutch mechanism (not shown). The control shaft 24 includes a protruding end 24*a* which protrudes from an aperture 30 defined in the side plate 18 of the appliance timer 12 in order to be coupled to the knob 26.

The camstack 28 includes a number of drive blades 32. Each of the drive blades 32 has defined therein a group of ratchet teeth 34. The ratchet teeth 34 cooperate with a drive pawl (not shown) in order to provide for rotation of the camstack 28.

Moreover, the camstack 28 includes a number of program blades 36 and 38. The program blade 36 has a number of cam lifts 36*a* and a number of cam drops 36*b* defined therein, whereas the program blade 38 has a number of cam lifts 38*a* defined therein (see FIG. 4). The drive blades 32 are non-rotatably coupled to each of the program blades 36, 38. More specifically, rotation of any of the drive blades 32 causes rotation of each of the program blades 36, 38.

The switch assembly 22 includes a number of lower or first circuit blades 44, a number of intermediate or second circuit blades 46, and a number of upper or third circuit blades 48. Each of the circuit blades 44, 46, 48 are insert molded into a contact wafer 64, 65, 68, respectively. One end of each of the circuit blades 44, 46, and 48 protrudes outwardly from the contact wafers 64, 65, 68, respectively, thereby defining electrical terminals 75, 77, 79, respectively, as shown in FIG. 3. The terminals 75, 77, 79 are provided to electrically couple components associated with the appliance 10 such as a main machine motor and a power source (not shown).

The circuit blades 44, 46, 48 are self-biased in the general direction of arrow A of FIG. 3. Therefore, another end of each of the circuit blades 44, 46, 48 is biased toward the camstack 28 and hence the program blades 36, 38.

Each of the lower circuit blades 44 includes a blade support 50. A contact surface 52 of the blade support contacts a number of camstack valleys 58 (see FIG. 4) defined in the camstack 28. The blade supports 50 are provided to maintain a constant distance between the lower circuit blades 44 and the camstack 28. By maintaining a constant distance between the lower circuit blades 44 and the camstack 28, the blade supports 50 compensate for any tolerance variations and wobble associated with the camstack 28. In addition, the blade supports prevent lateral movement of the lower circuit blades 44.

The blade support 50 also includes a support surface 54. A support tab 56 (see FIG. 3) defined in each of the upper circuit blades 48 is supported by the support surface 54. Therefore, the upper circuit blades 48 are maintained at a predetermined distance away from the lower circuit blades 44 when the intermediate circuit blades 46 are not urged toward the upper circuit blades 48 so as to raise the upper circuit blades away from the support surface 54.

Each of the intermediate circuit blades 46 includes a cam follower 62. The cam follower 62 cooperates with the cam surface 36 thereby allowing the intermediate circuit blades to be moved in the general direction of arrows A and B of FIG. 3. In particular, if the cam follower 62 contacts one of the cam lifts 36*a* of the program blade 36, the cam follower 62 and hence the intermediate circuit blade 46 is urged in the general direction of arrow B of FIG. 3. However, if the cam follower 62 drops into one of the cam drops 36*b* of the program blade 36, the cam follower 62 and hence the intermediate circuit blade 46 is urged in the general direction of arrow A of FIG. 3.

Figure 5:
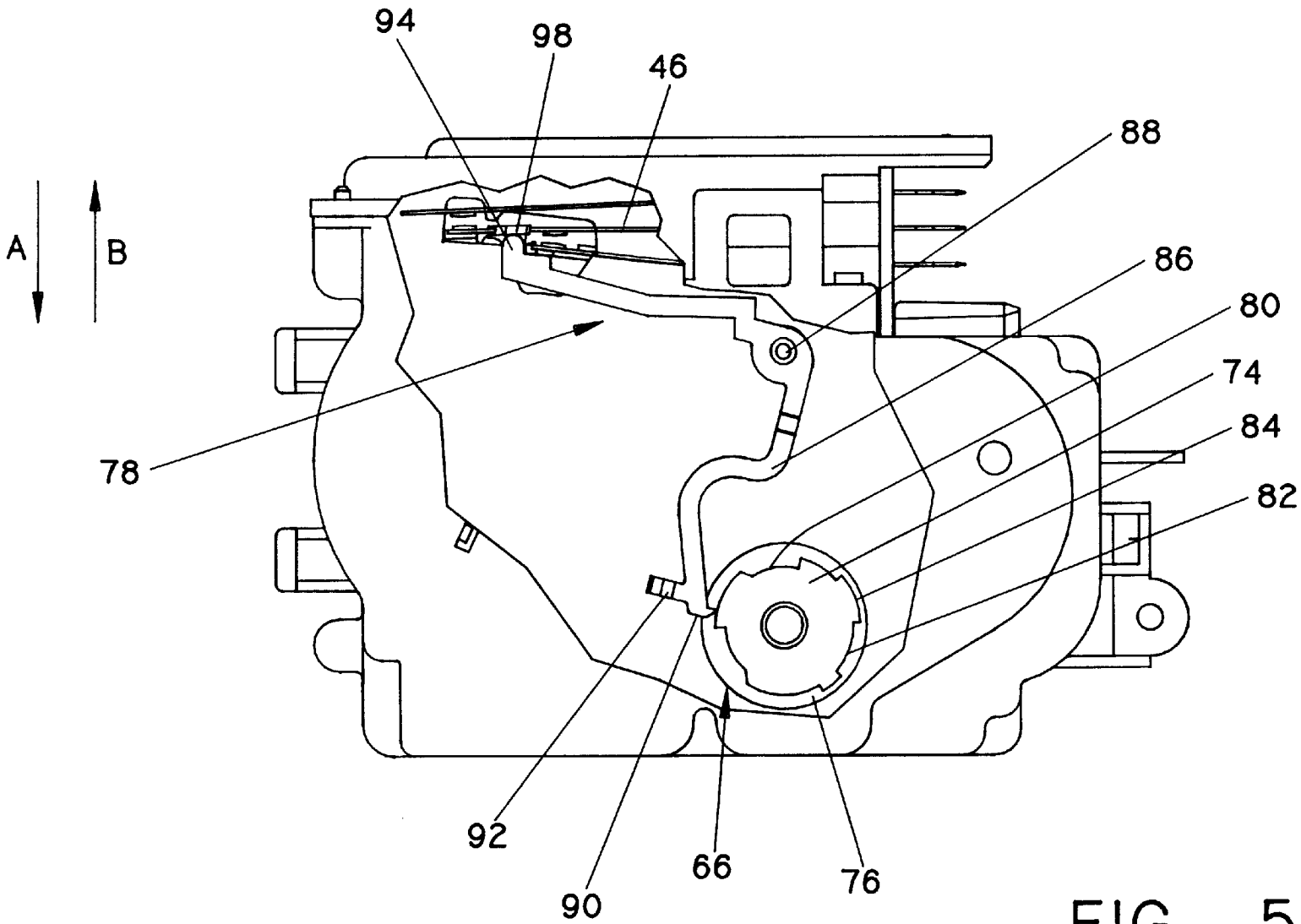
FIG. 5 is a rear cut-away view of the timer of FIG. 2 showing the internal components of the timer subinterval circuit.

Referring to FIG. 5, the timer 12 includes a drive system for advancing the camstack. The drive system includes a motor (not shown), a drive cam 66, and gear train (not shown). The motor transmits torque through a gear train to the drive cam 66 which in turn rotates the camstack 28 through the drive blades 32.

The drive cam 66 includes a subinterval cam 74 and a separation shelf 76. The drive cam 66, through the subinterval cam 74 operates a subinterval switch 78 (FIG. 5) by actuating a subinterval lever 86 to operate at least one intermediate circuit blade 46 independent of the camstack 28. The separation shelf 76 assists in capturing the subinterval lever 86 in the housing 16. The subinterval cam 74 is sequenced with the drive stroke to engage and disengage a timer circuit from the camstack 28 unless masked. The subinterval cam 74 includes a bottom cam profile 80, a neutral cam profile 82, and a top cam profile 84.

Referring to FIG. 5, the subinterval switch 78 includes a subinterval lever 86, a subinterval pivot bore 88, a subinterval follower 90, a subinterval foot 92, and a subinterval actuator 94. The subinterval switch 78 is configured to operate a subinterval electrical circuit 95 for a 15–20 second interval in order to operate a specific appliance function such as a clothes washing machine spray rinse. The subinterval lever 86 is preferably stamped from a steel zinc precoated stock with the burr side of the stamping away from the housing 16 to facilitate installation. The lever 86 is shaped to avoid interference with the housing 16 and other timer components. The subinterval switch 78 is configured for a double throw switch to make and break electrical circuits with both a lower circuit blade 44 and an upper circuit blade 48 by actuating the intermediate circuit blade 46 with the subinterval lever 86.

The subinterval pivot bore 88 cooperates with the housing 16 to provide a fulcrum for operation of the subinterval lever 86. The subinterval follower 90 cooperates with the subinterval cam 74 to convert rotary drive cam motion to a linear motion. The subinterval foot 92 contacts the housing 16 to position the subinterval follower 90 at the level of the subinterval cam 74 and provide a bearing surface when the subinterval lever 86 pivots in response to the subinterval cam 74. The subinterval actuator 94 contacts an intermediate circuit blade subinterval tab 98 (see FIGS. 3 and 5) to actuate an intermediate circuit blade 46. The subinterval actuator 94 is radiused to provide a bearing surface during actuation.

Figure 6:
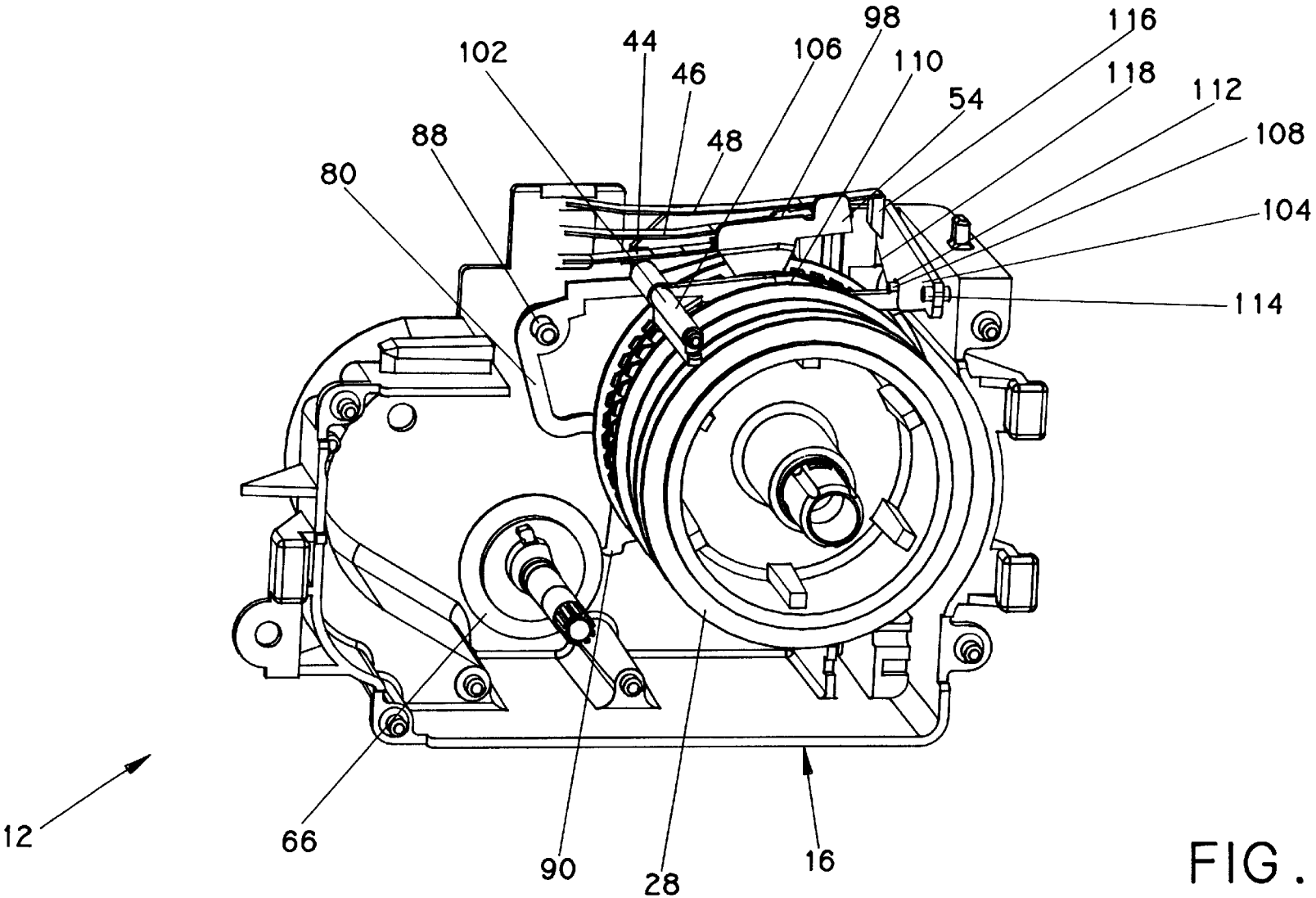
FIG. 6 is an exploded perspective view showing the relationship of the subinterval components and the camstack of the appliance timer of FIG. 2.
Figure 7:
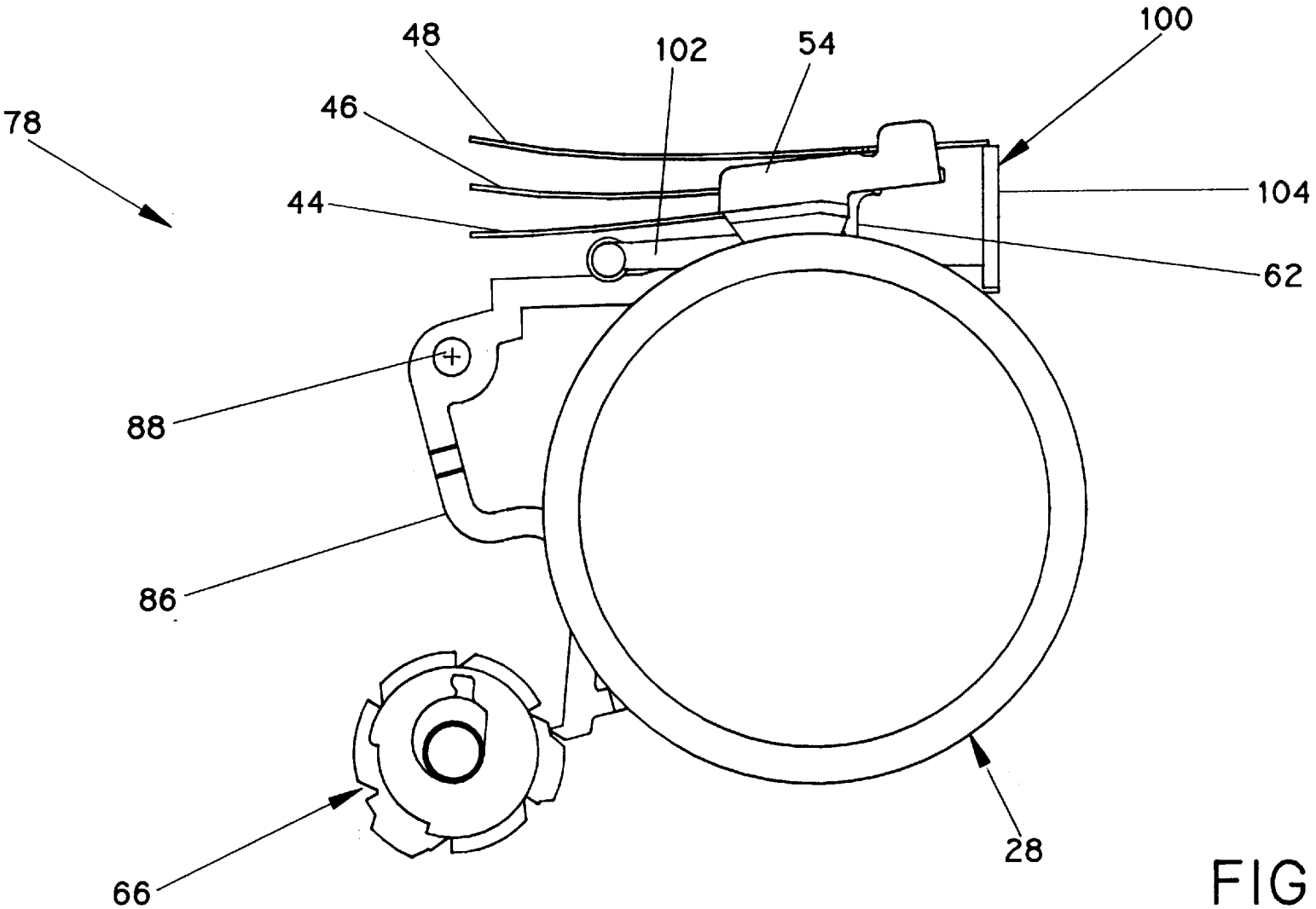
FIG. 7 is a view similar to FIG. 6, but showing in more detail the components of the subinterval circuit, the subinterval circuit masking lever; and the subinterval electrical circuit blades, each circuit blade being positioned in its respective neutral position.

Referring to FIGS. 6 and 7, the subinterval switch 78 further includes a masking lever 100. In the preferred embodiment, the masking lever 100 is a two piece design utilizing a first masking lever 102 and a second masking lever 104. The first masking lever 102 includes a first masking pivot bar 106 at a first end, a first masking lever lift 108 at a second end, and a masking lever camstack follower 110 disposed therebetween. The first masking lever pivot bar 106 pivotally engages both the housing 16 and the first side cover 18 perpendicular to the back surface of the housing and provides an axis of rotation around which the first masking lever pivot bar pivots. The first masking lever camstack follower 110 is positioned such that the camstack follower 110 engages a top masking lever program blade 126 of the camstack 28.

The second masking lever 104 includes a second masking lever slot 112, a second masking lever pivot pin 114, a second masking lever actuator 116, and a second masking lever guide 118. The second masking lever 104 is pivotally mounted at the second masking lever pivot pin 114 to the side plate 18. The second masking lever actuator 116 is at the opposite end of the second masking lever 104 from the pivot pin 114. The second masking lever slot 112 is located substantially in the middle between the two second masking lever ends. The first masking lever lift 108 is slideably connected to the second masking lever 104 at the second masking lever slot 112. The second masking lever actuator 116 contacts the upper circuit blade 48 of the subinterval circuit 95 at the end of the upper circuit blade 48 opposite the upper contact wafer 68 (see FIG. 6) to lift the upper circuit blade 48 beyond the travel of the intermediate circuit blade 46 of the subinterval circuit 95. The second masking lever guide 118 engages a groove in the back surface of the housing 16 to maintain proper alignment of the second masking lever 104 as it is pivots in response to the lifting action of the first masking lever 102.

Figure 8:
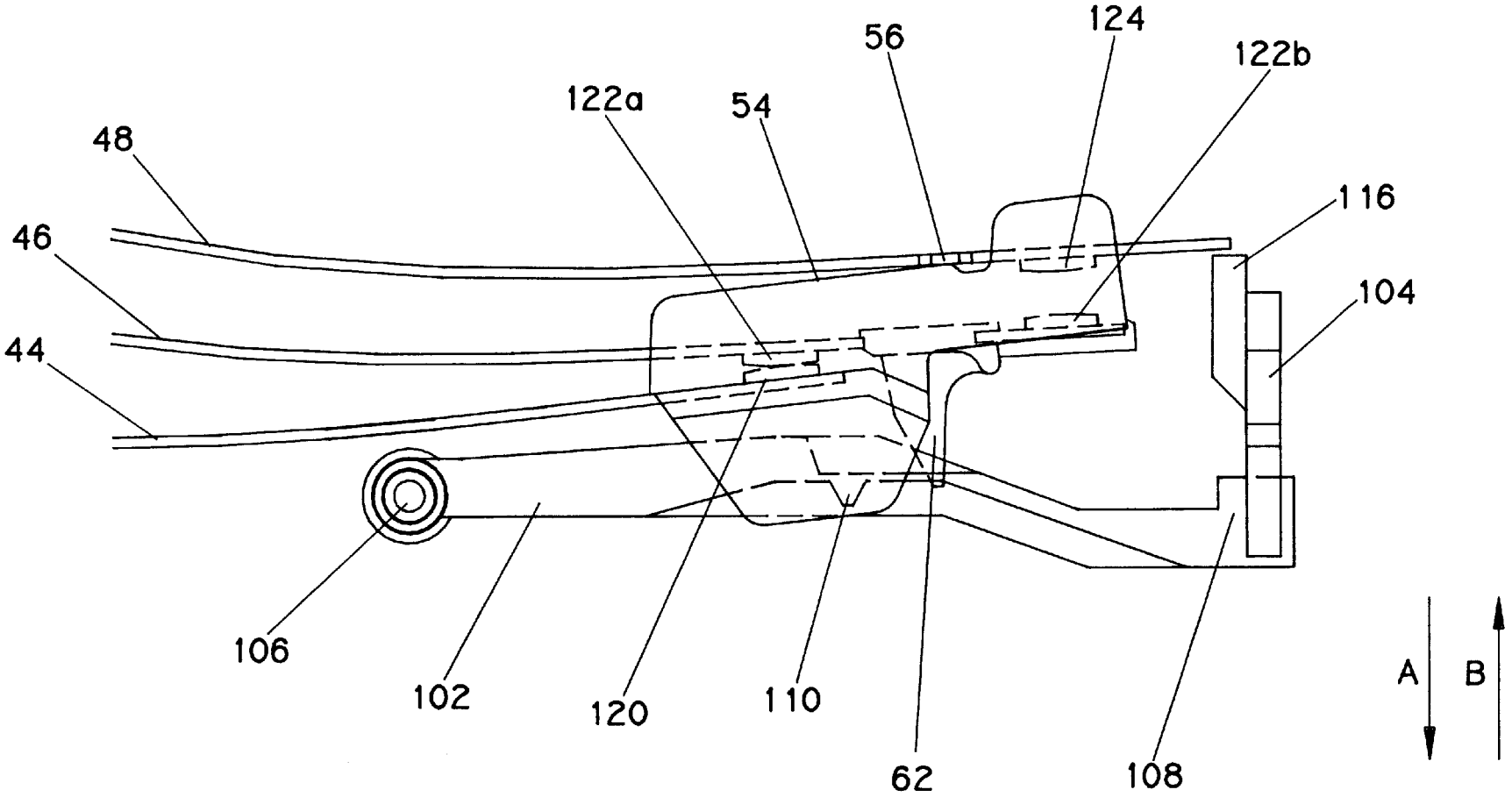
FIG. 8 is a side elevation view showing the circuit blades of the subinterval circuit with the intermediate circuit blade in a dropped position thereby making the bottom subinterval circuit.
Figure 9:
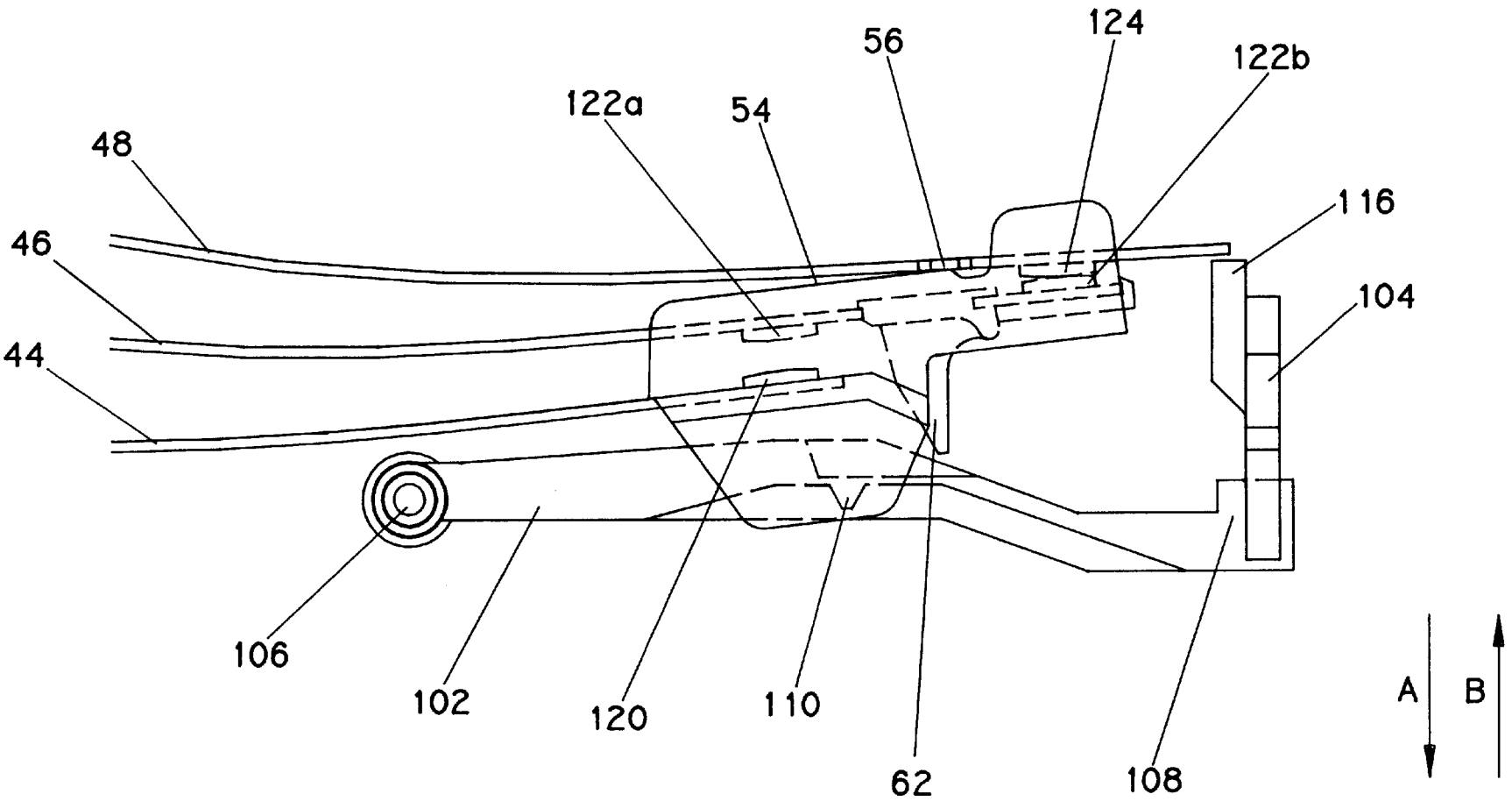
FIG. 9 is a view similar to FIG. 8, but showing the intermediate circuit blade in a raised position thereby making the top subinterval circuit; and, FIG. 10 is a view similar to FIG. 9, but showing the top masking lever in its actuated position, thereby moving the upper circuit blade beyond the travel of the intermediate circuit blade and masking the movement of the subinterval lever to raise the intermediate circuit blade.
Figure 10:
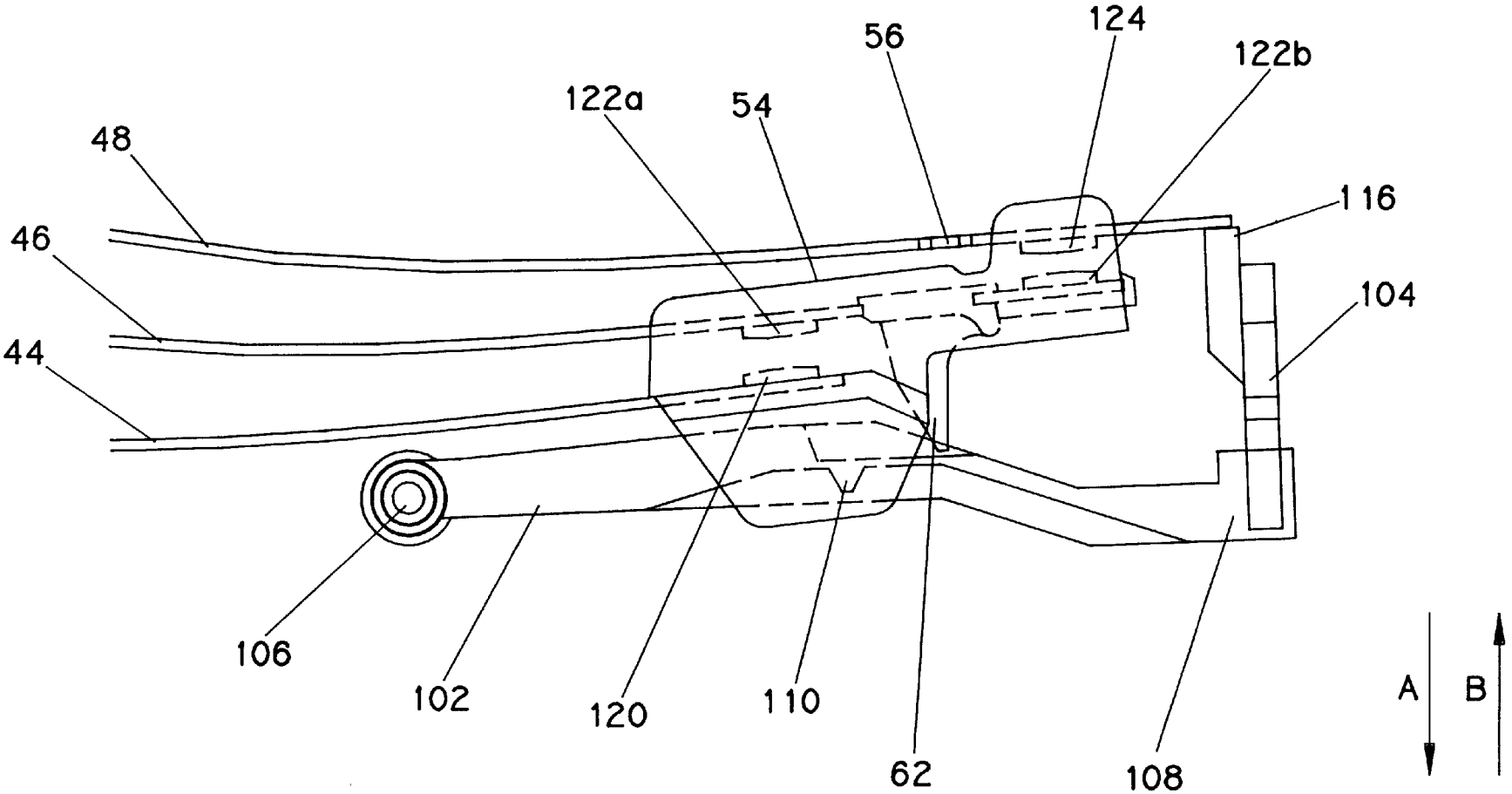

Referring now to FIGS. 8–10, operation of the appliance timer 12 and the subinterval switch 78 will now be discussed in more detail. Only one of the electrical circuit blades 44, 46, 48 are shown in FIGS. 8–10 for clarity of description.

Referring to FIG. 8, the lower circuit blade 44 and the upper circuit blade 48 are in the neutral position and the intermediate circuit blade 46 is in the dropped position. The lower circuit blade 44 neutral position occurs when the contact surface 52 of the blade support 50 contacts the cam valley 58 of the camstack 28 (FIG. 3). The upper circuit blade 48 is positioned in a neutral position when (1) the lower circuit blade 44 is positioned in the neutral position, and (2) the intermediate circuit blade 46 is not in contact with a cam lift 36*a* (as shall be discussed in more detail below). In this position, the upper circuit blade support tab 56 is positioned on the support surface 54 of the blade support 50.

Similarly, when the intermediate circuit blade 46 is not in contact with a cam lift 36*a* or a cam drop 36*b* (see FIG. 3), the intermediate circuit blade 46 is positioned in a neutral position. When (1) the intermediate circuit blade 46 is positioned in the neutral position, and (2) the lower circuit blade 44 and the upper circuit blade 48 are also positioned in their respective neutral positions, the intermediate circuit blade 46 is not in electrical contact with either the lower circuit blade 44 or the upper circuit blade 48. In particular, when the circuit blades 44, 46, and 48 are each positioned in the respective neutral positions thereof, an electrical contact 120 included on the upper surface of the lower circuit blade 44 is spaced apart from an electrical contact 122*a* included on the lower surface of the intermediate circuit blade 46. In addition, an electrical contact 124 included on the lower surface of the upper circuit blade 48 is spaced apart from an electrical contact 122*b* included on the upper surface of the intermediate circuit blade 46.

Referring to FIG. 9, in order to electrically couple the upper circuit blade 48 to the intermediate circuit blade 46, the cam follower 62 is advanced into contact with the cam lift 36*a* thereby moving the intermediate circuit blade 46 to an actuated position in which the intermediate circuit blade 46 is urged in the general direction of arrow B of FIG. 9. In this position, the upper circuit blade 48 is moved out of contact with the support surface 54 of the blade support 50 and is positioned in an offset position in which the upper blade 48 is supported by the intermediate blade 46 as shown in FIG. 9. When the intermediate circuit blade 46 is positioned in the actuated position, and the upper circuit blade 48 is positioned in the offset position, the intermediate circuit blade 46 is in electrical contact with the upper circuit blade 48. More specifically, the electrical contact 124 of the upper circuit blade 48 is electrically coupled to the electrical contact 122*b* of the intermediate circuit blade 46.

If it is desirable to electrically decouple the upper circuit blade 48 from the intermediate circuit blade 46, the cam follower 62 is advanced out of contact with the cam lift 36*a*. More specifically, if the cam follower 62 is advanced out of contact with the cam lift 36*a*, the cam follower 62 will drop or otherwise be urged in the general direction of arrow A of FIG. 9 thereby returning the intermediate circuit blade 46 to the neutral position. When the intermediate circuit blade 46 is returned to the neutral position, and the lower circuit blade 44 is positioned in the neutral position, the upper circuit blade 48 is also returned to the neutral position in which the upper circuit blade 48 is again supported by the support surface 54 of the blade support 50.

Referring to FIGS. 5–7, operation of the subinterval switch 78 is now discussed. The subinterval follower 90 contacts the subinterval cam 74 to provide linear motion to the subinterval lever 86. The radical motion of the subinterval follower 90 is transferred to the subinterval actuator 94. The subinterval actuator 94 contacts the intermediate blade subinterval tab 98 and causes the subinterval actuator 94 to press against the intermediate blade subinterval tab 98 to operate the subinterval circuit 95.

The motor, through a set of reduction gears rotates the drive cam 66. As the drive cam 66 rotates the subinterval follower 90, which engages the subinterval cam 74, is moved between the bottom cam profile 80, the neutral cam profile 82, and top cam profile 84. If the subinterval follower 90 is engaging the neutral profile 82 of the subinterval cam 74, the intermediate blade 46 of the subinterval circuit 95 is in the neutral position and the intermediate circuit blade 46 is not in electrical contact with either the lower circuit blade 44 or the upper circuit blade 48. In particular, the electrical contact 120 included on the upper surface of the lower circuit blade 44 is spaced apart from the electrical contact 122*a* included on the lower surface of the intermediate circuit blade 46. In addition, the electrical contact 124 included on the lower surface of the upper circuit blade 48 is spaced apart from the electrical contact 122*b* included on the upper surface of the intermediate circuit blade 46.

When the subinterval follower 90 engages the bottom profile 80 of the subinterval cam 74, the subinterval follower 90 drops. As the subinterval follower 90 drops, the subinterval lever 86 pivots about the subinterval lever pivot bore 88 causing the subinterval actuator 94 to move in the direction of arrow A as shown in FIG. 5. As the subinterval actuator 94 moves in the direction of arrow A, the intermediate circuit blade 46, which is biased in the direction of arrow A, also moves in the direction of arrow A. When the intermediate circuit blade drops, it makes electrical contact with the lower circuit blade 44. In particular, the electrical contact 122*a* on the lower surface of the intermediate circuit blade 46 is moved into contact with the electrical contact 120 included on the upper surface of the lower circuit blade 44 (see FIG. 8).

When the subinterval follower 90 engages the top profile 84 of the subinterval cam 74, the subinterval lever 86 pivots about the subinterval lever pivot bore 88 causing the subinterval actuator 94 to move in the direction of arrow B as shown in FIG. 5. As the subinterval actuator 94 moves in the direction of arrow B, the intermediate circuit blade 46 is moved by contact with the subinterval actuator 94 in the direction of arrow B. When the intermediate circuit blade 46 is raised, it makes electrical contact with the upper circuit blade 48. More specifically, the electrical contact 124 of the upper circuit blade 48 is electrically coupled to the electrical contact 122*b* of the intermediate circuit blade 46 (see FIG. 9).

Because the subinterval lever 86 is actuated with every revolution of the drive cam 66, it is necessary in the operation of the appliance to mask the making and breaking of the subinterval circuit 95. The actuation of the bottom subinterval circuit, that is when the intermediate circuit blade 46 drops into electrical contact with the lower circuit blade 44, can be masked by a cam profile 36 on the camstack 28. This is accomplished by utilizing a neutral radius on the cam profile 36. This way, even though the bottom subinterval cam profile 80 allows the subinterval lever 86 to drop, the intermediate circuit blade 46 of the subinterval circuit 95 is still held in the neutral position by the cam profile 36 of the camstack 28. In particular, the neutral position of the cam profile 36 prevents the electrical contact 122*a* from dropping into contact with the electrical contact 120 of the lower circuit blade.

Referring to FIGS. 6 and 7, in order to mask the operation of the top subinterval circuit, the first masking lever cam follower 110 cooperates with the top masking lever program blade 126 of the camstack 28 to move the first masking lever 102 and the second masking lever 104 in the general directions of Arrow B of FIG. 6. In particular, when the masking lever cam follower 110 contacts one of the cam lifts 126*a* of the top masking lever program blade 126, the first masking lever 102 pivots about the pivot pole 106 and thereby causes the first masking lever lift 108 to move in the general direction of arrow B of FIG. 6. By moving the first masking lever lift 108 in the direction of arrow B, the second masking lever is moved in the direction of arrow B as the second masking lever 104 is lifted at the second masking lever slot 112. When the second masking lever 104 is lifted at the slot 112, the second masking lever pivots around the pivot pin 114 thereby causing the second masking lever actuator 116 to move in the direction of arrow B. The actuator 116 contacts the upper circuit blade 48 of the subinterval circuit 95 and moves the blade 48 in the direction of arrow B beyond the travel of the intermediate circuit blade 46. (see FIG. 10). Therefore, if the second masking lever 104 is in this raised position, and the subinterval lever 86 is actuated by the top profile 84 of the subinterval cam 74, the intermediate circuit blade 46 moves in the direction of arrow B but the second masking lever 104 retains the upper circuit blade 48 in an offset position which is beyond the travel of the intermediate circuit blade 46 of the subinterval circuit 95. With the second masking lever 104 in this offset position, the subinterval circuit 95 cannot be electrically made and hence the top subinterval circuit has been masked.

While the invention has been illustrated and described in detail in the drawings and foregoing description, such illustration and description is to be considered as exemplary and not restrictive in character, it being understood that only the preferred embodiment has been shown and described and that all changes and modifications that come within the spirit of the invention are desired to be protected.

For example, the masking lever 100 can be manufactured as a single piece and will serve the same function as described above. However, by fabricating the masking lever in two pieces and by incorporating a pivot point into each, the lift associated with the cam lift 126*a* is multiplied and a relatively small lift in the direction of arrow B at the cam follower 110 is multiplied into a large motion in the direction of arrow B at the second masking lever actuator 116.

What is claimed is:

1. A timer for controlling an appliance, comprising:

a plurality of program blades corresponding to appliance functions;

a double throw subinterval circuit having electrical circuit blades which are movable to open and to close a top subinterval switch and a bottom subinterval switch;

a subinterval lever being movable to impart motion to said circuit blades to open and to close said top and said bottom subinterval switches independent of said plurality of program blades;

a masking lever engaging said circuit blades to prevent said closing of said top subinterval switch and thereby masking the movement of the electrical circuit blades of the top subinterval switch.

2. A timer for controlling an appliance, comprising:

a camstack having a plurality of program blades corresponding to predetermined appliance functions;

a camstack drive coupled to the camstack to rotate the camstack;

a top subinterval circuit, the making and breaking of which controls an appliance function;

a subinterval lever having a first end and a second end, said first end of said subinterval lever contacting the camstack drive to impart predetermined motion to the subinterval lever, said second end contacting said top subinterval circuit;

a masking lever engaging one of said program blades and contacting said top subinterval circuit to prevent the making and breaking of said top subinterval circuit.

3. A timer as in claim 2 wherein the camstack drive has an outer surface and the subinterval lever has a first end contacting the camstack drive outer surface.

4. A timer as in claim 3 wherein the subinterval lever is a double throw subinterval wherein the camstack drive outer surface has a bottom profile, a top profile, and a neutral profile.

5. A timer as in claim 4 wherein the at least one electrical circuit blade includes a top circuit blade, a bottom circuit blade, and an intermediate circuit blade positioned between the top and bottom circuit blades, said intermediate circuit blade being movable between a first offset position where the intermediate blade contacts the upper circuit blade, a neutral position, and a second offset position where the intermediate circuit blade contacts the bottom circuit blade.

6. A timer as in claim 5 wherein the subinterval lever has a second end contacting the intermediate electrical circuit blade.

7. A timer as in claim 6 wherein the intermediate blade is in the first offset position when the subinterval lever engages the upper profile of the camstack drive outer surface.

8. A timer as in claim 6 wherein the intermediate blade is in the neutral position when the subinterval lever engages the neutral profile of the camstack drive outer surface.

9. A timer as in claim 6 wherein the intermediate blade is in the second offset position when the subinterval lever engages the bottom profile of the camstack drive outer surface.

10. A timer as in claim 2 wherein the camstack top masking lever track includes a lower radius and a top radius, said masking lever preventing the making and breaking of an electrical circuit by the subinterval lever when said masking lever engages the masking lever track top radius.

11. A timer as in claim 10 wherein the masking lever does not prevent the making and breaking of an electrical circuit by the subinterval lever when the masking lever is engaging the camstack top masking lever track lower radius.

12. A timer for controlling an appliance, comprising:

a camstack having a plurality of program tracks corresponding to predetermined appliance functions;

a camstack drive coupled to the camstack to rotate the camstack;

a subinterval circuit having a bottom electrical blade, a top electrical blade, and an intermediate blade disposed between said bottom and said top blades; said intermediate blade being movable between a raised position where said intermediate blade makes a top subinterval circuit and a lowered position where said intermediate blade makes a bottom subinterval circuit;

a subinterval lever having a first end contacting the camstack drive and a second end positioned in working relation with the intermediate blade, said subinterval lever being pivotally mounted and movable in response to said camstack drive to move said intermediate blade into contact with the top blade or with the bottom blade;

a masking lever engaging a camstack program track, said masking level being movable between a raised position and a lowered position according to the program track, at said raised position said masking lever raising said upper blade beyond the travel of the intermediate blade thereby preventing the making of the top subinterval circuit, at said lowered position, said masking lever lowering the upper blade to allow the making of the top subinterval circuit.

13. A timer as in claim 12 wherein said camstack drive has an outer surface including a lower radius, an intermediate radius and an upper radius to pivotally impart movement to the subinterval lever second end to move the intermediate circuit blade between the top and the bottom circuit blades.

14. The timer as in claim 13 wherein when the subinterval lever first end is contacting the outer surface lower radius, the intermediate circuit blade moves into contact with the bottom circuit blade.

15. The timer as in claim 13 wherein when the subinterval lever first end is contacting the outer surface upper radius, the intermediate circuit blade moves into contact with the top circuit blade.

16. The timer as in claim 13 wherein when the subinterval lever first end is contacting the outer surface intermediate radius, the intermediate circuit blade is spaced apart from the top circuit blade and the bottom circuit blade.

17. The timer as in claim 13 wherein the first masking lever includes a cam-follower which engages the camstack program blade and a tip which contacts the upper circuit blade.

18. The timer as in claim 12 wherein said camstack includes a bottom masking program track, said subinterval bottom blade being movable between a raised position and a lowered position in response to said bottom masking program track.

19. The timer as in claim 18 wherein when said bottom blade is in its lowered position, said bottom blade is lowered beyond the travel of the intermediate blade thereby preventing electrical closure of the subinterval circuit.

20. The timer as in claim 18 wherein when said bottom blade is moved to its raised position, said bottom blade is within the travel of the intermediate blade thereby allowing electrical closure of the subinterval circuit.

* * * * *